US009982883B2

(12) United States Patent
Taguchi et al.

(10) Patent No.: US 9,982,883 B2
(45) Date of Patent: May 29, 2018

(54) VAPORIZATION SYSTEM

(71) Applicant: HORIBA STEC, Co., Ltd., Kyoto-shi, Kyoto (JP)

(72) Inventors: Akihiro Taguchi, Kyoto (JP); Masashi Hamada, Kyoto (JP); Hidetaka Yada, Kyoto (JP)

(73) Assignee: HORIBA STEC, Co., Ltd., Kyoto-shi, Kyoto (JP)

( * ) Notice: Subject to any disclaimer, the term of this patent is extended or adjusted under 35 U.S.C. 154(b) by 65 days.

(21) Appl. No.: 14/952,773

(22) Filed: Nov. 25, 2015

(65) Prior Publication Data

US 2016/0178193 A1 Jun. 23, 2016

(30) Foreign Application Priority Data

Dec. 22, 2014 (JP) ..... 2014-259534

(51) Int. Cl.
*F22D 5/30* (2006.01)
*F22B 1/28* (2006.01)
*F22D 5/34* (2006.01)

(52) U.S. Cl.
CPC ..... *F22D 5/30* (2013.01); *F22B 1/285* (2013.01); *F22D 5/34* (2013.01)

(58) Field of Classification Search
CPC ..... F22D 5/30; F22D 5/34; F22B 1/285
USPC ..... 392/402; 122/451 S
See application file for complete search history.

(56) References Cited

U.S. PATENT DOCUMENTS 1,942,861 A * 1/1934 Huster ..... F22B 29/08 122/1 B
2,170,345 A * 8/1939 Bailey ..... F22B 29/08 122/235.29
2,888,006 A * 5/1959 Martin ..... F24D 5/00 126/113
3,150,642 A * 9/1964 Profos ..... F01K 3/181 122/33
3,326,262 A * 6/1967 Weller, Jr. ..... F23D 11/445 392/342
4,139,762 A * 2/1979 Pohrer ..... F24F 6/18 126/113
4,271,792 A * 6/1981 Wittchow ..... F22B 37/14 122/406.4

(Continued)

FOREIGN PATENT DOCUMENTS

JP 2003273026 A 9/2003
WO 2010101077 A1 9/2010

*Primary Examiner* — Eric Stapleton
(74) *Attorney, Agent, or Firm* — Alleman Hall Creasman & Tuttle LLP

(57) ABSTRACT

The present invention makes it possible to reduce the size of a vaporization system by eliminating the need for conduits in the vaporization system, without it being necessary to form a flow path in order for a supply rate controller to be mounted inside a vaporizer, and is formed by a vaporizer that vaporizes a liquid material; a supply rate controller that controls a supply rate of the liquid material to the vaporizer; and a manifold block inside which an internal flow path is formed, and that has a device mounting surface on which both the vaporizer and the supply rate controller are mounted, wherein, as a result of the vaporizer and the supply rate controller being mounted on the device mounting surface, they are connected together via the flow path.

6 Claims, 2 Drawing Sheets

(56) References Cited

U.S. PATENT DOCUMENTS 4,419,302 A * 12/1983 Nishino ..... F22B 1/284 122/487
4,489,679 A * 12/1984 Holt ..... F22D 1/00 110/186
4,660,511 A * 4/1987 Anderson ..... F01K 23/04 122/1 C
5,279,129 A * 1/1994 Ito ..... F17C 9/02 122/4 A
5,537,508 A * 7/1996 Ebbing ..... F22B 1/284 392/399
5,605,179 A * 2/1997 Strong, Jr. ..... F16K 27/003 137/240
5,630,878 A * 5/1997 Miyamoto ..... C23C 16/4485 118/715
5,769,110 A * 6/1998 Ohmi ..... F15B 13/0817 137/269
5,832,639 A * 11/1998 Muncan ..... F22B 1/285 237/67
5,881,207 A * 3/1999 DeBourg ..... F22B 1/285 340/618
6,067,403 A * 5/2000 Morgandi ..... F22B 1/285 38/77.6
6,263,904 B1 * 7/2001 Zdunek ..... C23C 8/02 118/728
6,648,020 B2 * 11/2003 Fujimoto ..... F16K 27/003 137/343
7,556,059 B2 * 7/2009 Takeda ..... B67D 7/0272 137/588
9,157,578 B2 * 10/2015 Hayashi ..... F17C 9/02
2002/0096211 A1 * 7/2002 Zheng ..... F17C 5/02 137/240
2006/0124179 A1 * 6/2006 Fukagawa ..... F16K 27/003 137/597
2006/0180078 A1 * 8/2006 Iizuka ..... C23C 16/4486 118/50
2008/0085226 A1 * 4/2008 Fondurulia ..... C23C 16/4481 422/198
2008/0173240 A1 * 7/2008 Furukawahara ..... C23C 16/54 118/726
2008/0296791 A1 * 12/2008 Okabe ..... C23C 16/405 261/141
2008/0305014 A1 * 12/2008 Honda ..... G05D 7/0641 422/111
2009/0232986 A1 * 9/2009 Choi ..... C23C 16/45561 427/255.28
2009/0320754 A1 * 12/2009 Oya ..... C23C 16/455 118/715
2011/0314838 A1 * 12/2011 Hayashi ..... F17C 9/02 62/48.1

* cited by examiner

VAPORIZATION SYSTEM

The present invention relates to a vaporization system that vaporizes a liquid material.

TECHNICAL BACKGROUND

Conventionally, a vaporization system that vaporizes a liquid material is used to create the gas that is used in a semiconductor manufacturing process such as, for example, a film formation process or the like.

This vaporization system, as is shown, for example, in Patent document 1, is provided with a vaporizer that holds a liquid material and vaporizes this liquid material by heating it, and with a supply rate controller (for example, a mass flow controller or flow rate control valve or the like) that controls the supply rate of the liquid material that is supplied to that vaporizer.

However, because the vaporizer and the supply rate controller are connected together by a conduit, this conduit makes it difficult for the size of the vaporization system to be reduced. A structure in which the supply rate controller is mounted on top of the vaporizer in order to reduce the length dimension of the vaporization system by the distance of the conduit length might also be considered, however, it is necessary for the conduit to be folded back on itself inside the vaporization system so that this would make the structure of the vaporization system more complex.

Note that, as is shown in Patent document 2, a structure in which a supply rate control valve (i.e., the supply rate controller) is mounted directly on a side wall of the vaporization tank of the vaporizer, and this vaporization tank is mounted on a gas panel might also be considered. However, in this structure, it is necessary to provide the supply rate control valve on a side wall of the vaporization tank and to form a complex flow path in order to control the flow rate. In addition, when removing the vaporization tank, the flow rate control valve must also be removed, so that replacement tasks and the like are awkward to perform.

DOCUMENTS OF THE PRIOR ART

Patent Documents

[Patent document 1] Japanese Unexamined Patent Application (JP-A) No. 2003-273026

[Patent document 2] International Patent Publication No. 2010/101077

DISCLOSURE OF THE INVENTION

Problems to be Solved by the Invention

The present invention was therefore conceived in order to solve the above-described problems, and it is a principal object thereof to reduce the size of a vaporization system by eliminating the need for conduits in the vaporization system, without it being necessary to form a flow path in order for the supply rate controller to be mounted inside a vaporizer.

Means for Solving the Problem

Namely, the vaporization system according to the present invention is equipped with: a vaporizer that vaporizes a liquid material; a supply rate controller that controls a supply rate of the liquid material to the vaporizer; and a manifold block inside which an internal flow path is formed, and that has a device mounting surface on which both the vaporizer and the supply rate controller are mounted, wherein, as a result of the vaporizer and the supply rate controller being mounted on the device mounting surface, they are connected together via the flow path.

If this type of structure is employed, then because the vaporizer and the supply rate controller are connected together via the flow path in the manifold block when they are mounted on the device mounting surface of that manifold block, it is possible to eliminate any conduits between the vaporizer and the supply rate controller, so that the size of the vaporization system can be reduced. Moreover, because the vaporizer and the supply rate controller are each mounted on the device mounting surface, there is no need to form a flow path inside the vaporizer in order to install the supply rate controller, so that the structure of the vaporizer can be simplified. Furthermore, the vaporizer and the supply rate controller can be individually attached to or removed from the manifold block, so that replacement tasks can be simplified. In addition to this, because a structure is employed in which the vaporizer and the supply rate controller are mounted on the manifold block, it is also possible to create a structure in which the vaporization system is incorporated into other gas panels.

It is desirable for there to be further provided a preheater that preheats the liquid material that is supplied to the vaporizer to a predetermined temperature, and for the preheater to be connected to the vaporizer and the supply rate controller via the flow paths by mounting the preheater on the device mounting surface.

If this type of structure is employed, because the liquid material that is supplied to the vaporizer is preheated, there is no need to provide a large-sized heater in the vaporizer, so that the size of the vaporizer can be reduced. Moreover, because a structure is employed in which the preheater is connected to the vaporizer and the supply rate controller via the flow paths as a result of the preheater being mounted onto the device mounting surface, there is no need to provide a conduit in the vaporization system that is provided with this preheater, so that the size of this vaporization system can be reduced.

It is also desirable for there to be further provided: a fluid detector that detects physical quantities relating to the flow rate of the vaporized gas created by the vaporizer; and a flow rate control valve that controls the flow rate of the vaporized gas created by the vaporizer, and for the fluid detector and the flow rate control valve to be connected to the vaporizer via the flow path as a result of the fluid detector and the flow rate control valve being mounted on the device mounting surface.

If this type of structure is employed, the fluid detector and the flow rate control valve are mounted on the manifold block so that the vaporization system is endowed with the function of controlling the flow rate of the vaporized gas, and there is no need to provide any conduits between the vaporizer, the fluid detector, and the flow rate control valve so that the size of the vaporization system can be reduced.

It is also desirable for the manifold block to be constructed by connecting together a first body unit onto which the vaporizer and the supply rate controller are mounted, and a second body unit onto which the fluid detector and the flow rate control valve are mounted.

If this type of structure is employed, because the manifold block is formed by the individually separate first body unit and second body unit, it is far easier to form flow paths compared to when the manifold block is formed by a single block.

It is also desirable for a first heater that heats the first body unit to be provided in the first body unit, and for a second heater that heats the second body unit to be provided in the second body unit.

If this type of structure is employed, because the heaters are provided respectively in the first body unit and the second body unit, the first body unit and the second body unit can each be controlled to their appropriate temperatures, so that not only can the vaporization efficiency be improved, but any reliquification of the vaporized gas can be prevented. At this time, it is desirable for the temperature of the second body unit to be hotter than that of the first body unit. Moreover, because the manifold block is separated into the first body unit and the second body unit, the processing to form the holes for inserting the heaters is easy.

Effects of the Invention

According to the present invention which has the above-described structure, because the vaporizer and supply rate controller are connected to each other via the flow paths in the manifold block when the vaporizer and the supply rate controller are mounted on the device mounting surface of the manifold block, there is no need for any flow path to be formed inside the vaporizer in order for the supply rate controller to be mounted, so that any conduits in the vaporization system can be eliminated and the size of the vaporization system can be reduced.

BEST EMBODIMENTS FOR IMPLEMENTING THE INVENTION

Hereinafter, an embodiment of a vaporization system according to the present invention will be described with reference made to the drawings.

Figure 1:
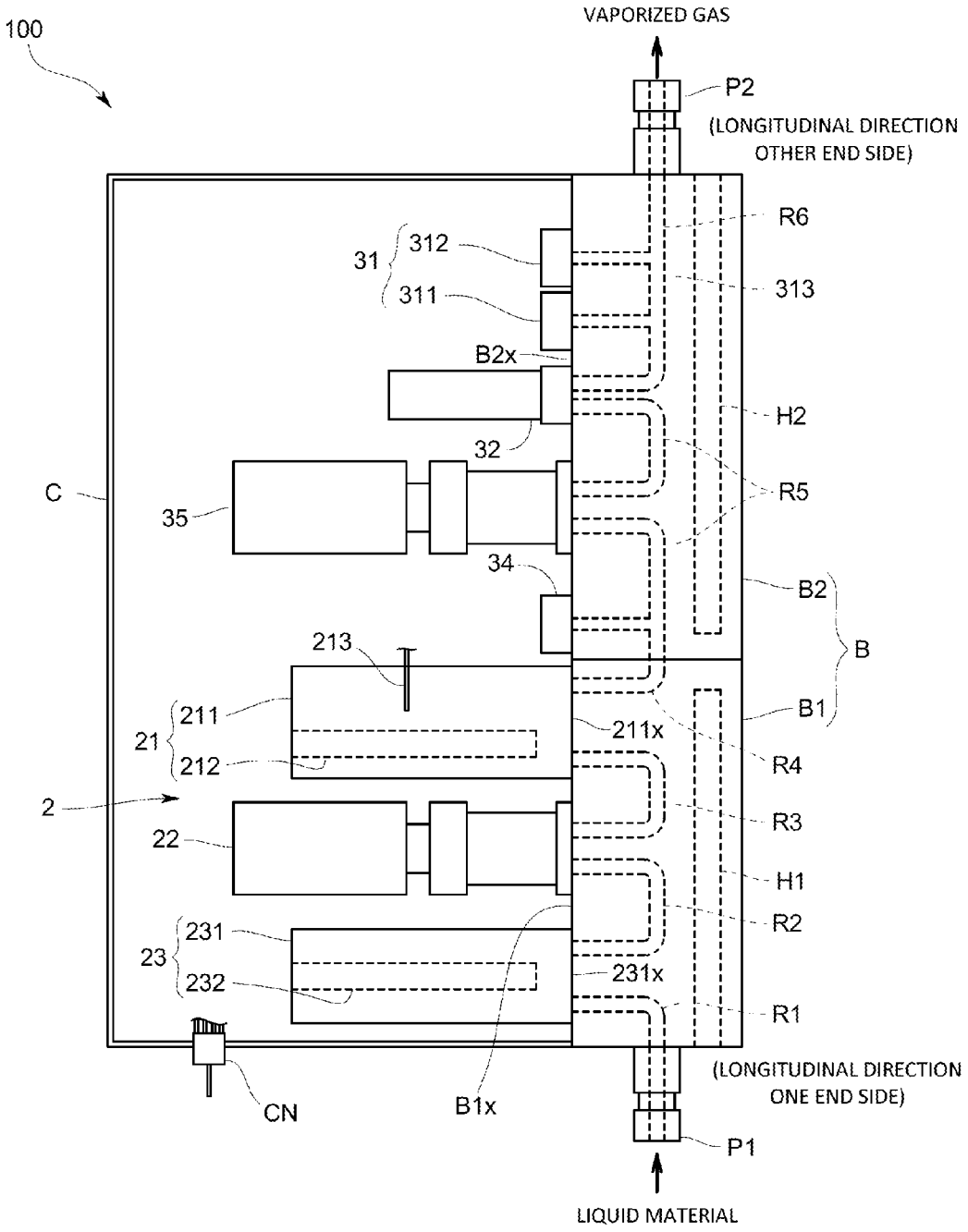
FIG. 1 is a typical view showing the structure of a vaporization system according to the present embodiment.

A vaporization system 100 of the present embodiment is used to supply gas at a predetermined flow rate to a chamber that is incorporated, for example, on a semiconductor manufacturing line or the like, and is where a semiconductor manufacturing process is performed. As is shown in FIG. 1, the vaporization system 100 is equipped with a vaporization unit 2 that vaporizes a liquid raw material, and a mass flow controller 3 that controls the flow rate of the gas that is vaporized by this vaporization unit 2.

The vaporization unit 2 is provided with a vaporizer 21 that vaporizes a liquid material using a baking method, a supply rate controller 22 that controls the supply rate of the liquid material to the vaporizer 21, and a preheater 23 that preheats the liquid material supplied to the vaporizer 21 to a predetermined temperature.

The vaporizer 21, the supply rate controller 22, and the preheater 23 are mounted on a device mounting surface B1*x* that is set on one surface of a body unit B1 (hereinafter, this is referred to as a first body unit B1), which is a manifold block that has an internal flow path formed inside it. Here, the first body unit B1 is made from a metal such as, for example, stainless steel or the like, and has the general outline of an elongated column (specifically, the general outline of a rectangular parallelepiped). The aforementioned device mounting surface B1*x* is an elongated rectangular surface. Note that the first body unit B1 of the present embodiment is installed on a semiconductor manufacturing line or the like such that the longitudinal direction thereof is aligned in an up-down direction (i.e., in a vertical direction).

Specifically, the preheater 23, the supply rate controller 22, and the vaporizer 21 are mounted on a straight line that extends in the longitudinal direction on the device mounting surface B1*x*. Moreover, the preheater 23, the supply rate controller 22, and the vaporizer 21 are connected together in series in this sequence from the upstream side by internal flow paths (R1~R4) that are formed in the first body unit B1. Note also that a heater H1 that is used to heat the liquid material flowing through the internal flow paths (R1~R4) is also provided inside the first body unit B1. Moreover, an aperture on the upstream side of the internal flow path R1 in the first body unit B1 is connected to a liquid material intake port P1 that is provided in a surface at one end in the longitudinal direction of the first body unit B1.

The vaporizer 21 has a storage vessel 211 in the form of a vaporization tank that has an internal space for storing a liquid material, and a vaporizer heater 212 that is provided in the storage vessel 211 and is used to vaporize the liquid material.

The storage vessel 211 has a mounting surface 211*x* that is mounted on the device mounting surface B1*x* of the first body unit B1. The storage vessel 211 of the present embodiment has the general outline of, for example, an elongated column, and a surface at one end in the longitudinal direction thereof serves as the mounting surface 211*x*. Specifically, the storage vessel 211 has the general outline of a rectangular parallelepiped. Moreover, the storage vessel 211 of the present embodiment is installed on a semiconductor manufacturing line or the like such that the longitudinal direction thereof is aligned in a horizontal direction.

An intake port that is used to introduce a liquid material from the internal flow path R3 in the first body unit B1, and a discharge port that is used to discharge vaporized gas into the internal flow path R4 in the first body unit B1 are formed in the mounting surface 211*x*. Moreover, by mounting the mounting surface 211*x* of the storage vessel 211 on the device mounting surface B1*x* of the first body unit B1, the intake port formed in the mounting surface 211*x* is able to communicate with the aperture of the internal flow path R3 (i.e., the aperture on the downstream side) that is formed in the device mounting surface B1*x*, and the discharge port formed in the mounting surface 211*x* is able to communicate with the aperture of the internal flow path R4 (i.e., the aperture on the upstream side) that is formed in the device mounting surface B1*x*.

A liquid level sensor 213 that is used to detect the storage volume of the stored liquid material is also provided in the storage vessel 211. In the present embodiment, the liquid level sensor 213 is inserted into the interior through the top wall of the storage vessel 211.

The vaporizer heater 212 is inserted through a wall portion (for example, a bottom wall portion) of the storage vessel 211. Specifically, the vaporizer heater 212 is inserted (in the longitudinal direction) towards the first body unit B1 from the surface on the opposite side from the mounting surface 211*x* (i.e., from the other end surface in the longitudinal direction).

The supply rate controller 22 is a control valve that controls the flow rate of the supply of liquid material to the vaporizer 21, and, in the present embodiment, is a solenoid shut-off valve. This solenoid shut-off valve 22 is mounted such that it covers the aperture (i.e., the aperture on the downstream side) of the internal flow path R2 and the aperture (i.e., the aperture on the upstream side) of the internal flow path R3 that are formed in the device mounting surface B1$x$ of the first body unit B1. Specifically, a valve body (not shown) of the solenoid shut-off valve 22 is created such that it is able to either open up or block off the aperture (i.e., the aperture on the downstream side) of the internal flow path R2 and the aperture (i.e., the aperture on the upstream side) of the internal flow path R3 that are formed in the device mounting surface B1$x$.

In addition, a controller (not shown) controls the turning ON and OFF of the solenoid shut-off valve 22 based on detection signals from the liquid level sensor 213 provided in the storage vessel 211 such that the liquid material stored in the storage vessel 211 is kept constantly at a predetermined volume. By doing this, during a vaporization operation, the liquid material is supplied intermittently to the vaporizer 21. Here, if the supply flow rate of the liquid material is controlled by supplying it intermittently using ON/OFF control, then compared with when the supply flow rate of the liquid material is controlled continuously using a mass flow controller or the like, the size of the vaporizer unit 2 can be reduced.

The preheater 23 has a preheating block 231 that has an internal flow path through which the liquid material is able to flow, and a preheating heater 232 that is used to preheat the liquid material provided in this preheating block 231. The liquid material is heated by this preheater 23 to a temperature immediately prior to vaporization (i.e., to just less than boiling point).

The preheating block 231 has a mounting surface 231$x$ that is mounted onto the first body unit B1. The preheating block 231 of the present embodiment has the general outline, for example, of an elongated column, and one end surface in the longitudinal direction thereof serves as the mounting surface 231$x$. Specifically, the preheating block 231 has the general outline of a rectangular parallelepiped. Moreover, the preheating block 231 of the present embodiment is installed on a semiconductor manufacturing line or the like such that the longitudinal direction thereof is aligned in a horizontal direction. An insertion hole is also formed in the preheating block 231. This insertion hole is used to insert the preheating heater 232 in the longitudinal direction from a central portion of the other end surface in the longitudinal direction of the preheating block 231.

An intake port that is used to introduce the liquid material from the internal flow path R1 in the first body unit B1, and a discharge port that is used to discharge the preheated liquid material into the internal flow path R2 in the first body unit B1 are formed in the mounting surface 231$x$. Moreover, by mounting the mounting surface 231$x$ of the preheating block 231 on the device mounting surface B1$x$ of the first body unit B1, the intake port that is formed in the mounting surface 231$x$ is able to communicate with the aperture of the flow path R1 (i.e., the aperture on the downstream side) that is formed in the device mounting surface B1$x$, and the discharge port that is formed in the mounting surface 231$x$ is able to communicate with the aperture of the flow path R2 (i.e., the aperture on the upstream side) that is formed in the device mounting surface B1$x$.

By inserting the preheating heater 232 into the insertion hole that is formed in the preheating block 231, the preheating heater 232 is positioned so as to face the first body unit B1 (in the longitudinal direction) from the surface of the preheating block 231 on the opposite side from the mounting surface 231$x$ (i.e., from the other end surface in the longitudinal direction).

In the preheating block 231, the flow path through which the liquid material flows has a plurality of longitudinal flow path portions that are formed so as to extend in the longitudinal direction, and transverse flow path portions that are formed so as to extend in a transverse direction that is orthogonal to the aforementioned longitudinal direction, and that connect together end portions of the longitudinal flow path portions. A reciprocating flow path that turns back on itself either once or a plurality of times between the one end and the other end in the longitudinal direction inside the preheating block 231 so as to surround the periphery of the preheating heater 232 is formed by the longitudinal flow path portions and the transverse flow path portions.

If the vaporization unit 2 having the above-described structure is employed, the liquid material that is introduced via the liquid material intake port P1 is preheated to a predetermined temperature as a result of flowing through the flow path in the preheating block 231 of the preheater 23. The liquid material that is preheated by the preheater 23 is introduced intermittently into the vaporizer 21 by the ON/OFF control of the solenoid shut-off valve 22, which is serving as a supply rate controller. The liquid material is thus constantly maintained in the vaporizer 21 so that the liquid material can be vaporized without being affected by the ON/OFF control of the solenoid shut-off valve 22, and vaporized gas can thereby be generated continuously, and can be continuously discharged to the mass flow controller 3.

Next, the mass flow controller 3 will be described.

The mass flow controller 3 is provided with a fluid detector 31 that detects vaporized gas flowing through the flow path, and with a flow rate control valve 32 that controls the flow rate of the vaporized gas flowing through the flow path. Note that the fluid detector 31 is formed by, for example, an electrostatic capacitance-type first pressure sensor 311 that detects the pressure on the upstream side of a fluid resistor 313 that is provided on the flow path, and by, for example, an electrostatic capacitance-type second pressure sensor 312 that detects the pressure on the downstream side of the fluid resistor 313. Moreover, the fluid detector 31 is a control valve that controls the flow rate of the vaporized gas created by the vaporizer 21 and, in the present embodiment, is a piezo valve.

The fluid detector 31 and the flow rate control valve 32 are mounted on a device mounting surface B2$x$ that is set on one surface of a body unit B2 (hereinafter, referred to as the second body unit B2) which is a manifold block having an internal flow path formed inside it. Here, the second body unit B2 is made from a metal such as, for example, stainless steel, and has the general outline of an elongated column. The device mounting surface B2$x$ is an elongated rectangular surface. Note also that the width dimensions of the device mounting surface B2$x$ of the second body unit B2 are the same as the width dimensions of the device mounting surface B1$x$ of the first body unit B1.

Specifically, the flow rate control valve 32 and the fluid detector 31 are mounted in a line that extends in the longitudinal direction on the device mounting surface B2$x$. Moreover, the flow rate control valve 32 and the fluid detector 31 are connected together in series in this sequence from the upstream side by internal flow paths (R5 and R6) that are formed in the second body unit B2. Note that, in the present embodiment, an upstream-side pressure sensor 34 and a shut-off valve 35 are provided on the upstream side of the flow rate control valve 32. In addition, a heater H2 that is used to heat the gas flowing through the internal flow paths (R5 and R6) is also provided in the second body unit B2. Furthermore, a downstream-side aperture of the internal flow path R6 in the second body unit B2 connects to a vaporized gas discharge port P2 that is provided in the other end surface in the longitudinal direction of the second body unit B2.

The second body unit B2 of the mass flow controller 3 is joined by means of screws or the like to the first body unit B1 of the vaporizer unit 2 so as to form a main body unit B. This main body unit B is installed on a semiconductor manufacturing line or the like such that the longitudinal direction thereof is aligned in an up/down direction (i.e., in a vertical direction), such that the liquid material intake port P1 is positioned on the lower side and the vaporized gas discharge port P2 is positioned on the upper side. Moreover, a housing C that houses the devices that are mounted on one surface of the main body unit B is also mounted on the main body unit B. Note that the symbol CN denotes a connector that is used to connect an external control device.

Figure 2:
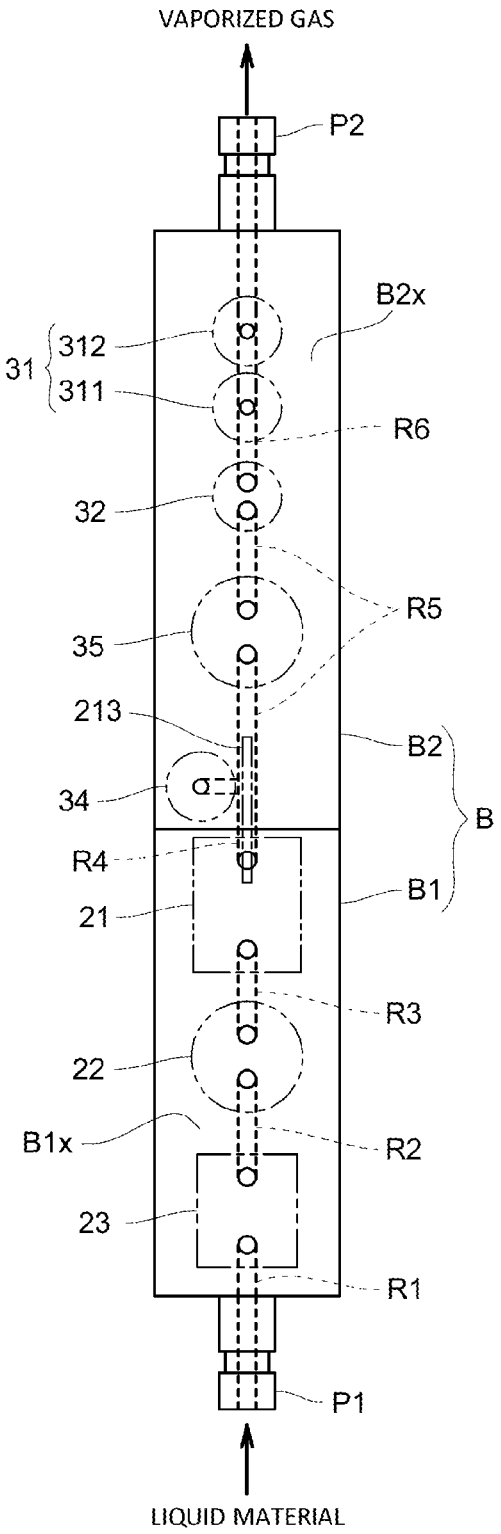
FIG. 2 is a plan view as seen from a mounting surface of a main body unit (i.e., a first body unit and a second body unit) according to the same embodiment.

Moreover, in this main body unit B, a portion of the devices 21-23, and 31-35 that are mounted on the main body unit B are arranged in a zigzag pattern. Specifically, as is shown in FIG. 2, the upstream-side pressure sensor 34 that is mounted on the second body unit B2 is offset in a transverse direction relative to the vaporizer 21 and the shut-off valve 35 so as to form a zigzag pattern. More specifically, when viewed from the liquid material intake port P1, the fluid intake port through which a fluid is introduced into the upstream-side pressure sensor 34 is formed at an inclined angle relative to the device mounting surface B2*x*. As a result, it is possible to reduce the size of the vaporization system 100 in the longitudinal direction, while maintaining a structure in which nothing obstructs the liquid level sensor 213 that is provided in the vaporizer 21. Note that it is also possible for all of the devices to be arranged in a zigzag pattern.

According to the vaporization system 100 of the present embodiment, because the vaporizer 21 and supply rate controller 22 are connected to each other via the flow paths R1~R4 in the first body unit B1 when the vaporizer 21 and the supply rate controller 22 are mounted on the device mounting surface B1*x* of the first body unit B1, there is no need for any conduits to be provided between the vaporizer 21 and the supply rate controller 22, so that the size of the vaporization system 100 can be reduced. Moreover, because the vaporizer 21 and the supply rate controller 22 are each mounted on the device mounting surface B1*x*, there is no need to form a flow path inside the vaporizer 21 in order to install the supply rate controller 22, so that the structure of the vaporizer 21 can be simplified. Furthermore, the vaporizer 21 and the supply rate controller 22 can be individually attached to or removed from the first mounting block B1 so that replacement tasks can be simplified. In addition to this, because a structure is employed in which the vaporizer 21 and the supply rate controller 22 are mounted on the first body unit B1, it is also possible to create a structure in which the vaporization system 100 is incorporated into other gas panels.

Moreover, according to the present embodiment, because the liquid material that is supplied to the vaporizer 21 is preheated by the preheater 23, there is no need to increase the size of the heater 212 in the vaporizer 21, so that the size of the vaporizer 21 can be reduced. Furthermore, because the liquid material is preheated by the preheater 23, even if the liquid material is supplied intermittently to the storage vessel (i.e., the vaporization tank) 211, there are only small temperature changes in the storage vessel 211, so that high flow rate vaporization can be performed stably even in the small-sized vaporization system 100. In addition to this, because a structure is employed in which the preheater 23 is connected via the flow paths R1~R4 to the vaporizer 21 and the supply rate controller 22 when the preheater 23 is mounted on the device mounting surface B1*x*, there is no need to provide a conduit in the vaporization system 100 that is provided with this preheater 23, so that the size of this vaporization system 100 can be reduced.

Furthermore, according to the present embodiment, the fluid detector 31 and the flow rate control valve 32 are mounted on the main body unit B so that the vaporization system 100 is endowed with the function of controlling the flow rate of the vaporized gas, and there is no need to provide any conduits between the vaporizer 21, the fluid detector 31, and the flow rate control valve 32 so that the size of the vaporization system 100 can be reduced. Here, because the main body unit B is formed by the individually separate first body unit B1 and second body unit B2, it is far easier to form flow paths compared to when the main body unit B is formed by a single block. Moreover, because the heaters H1 and H2 are provided respectively in the first body unit B1 and the second body unit B2, the first body unit B1 and the second body unit B2 can each be controlled to their appropriate temperatures, so that not only can the vaporization efficiency be improved, but any reliquification of the vaporized gas can be prevented. At this time, it is desirable for the temperature of the second body unit B2 to be hotter than that of the first body unit B1. Moreover, because the main body unit B is separated into the first body unit B1 and the second body unit B2, the processing to form the holes for inserting the heaters H1 and H2 is easy.

In addition to this, because a structure is employed in which the vaporizer 21 and the supply rate controller 22 that make up the vaporization unit 2 are mounted on the first body unit B1, which is a manifold block, there is no need for any conduit connectors such as conduit couplings and the like, so that the size of the vaporization unit 2 can be reduced. Moreover, as a result of this size reduction, the preheater 23, which has conventionally been prepared on the user side, is mounted on the first body unit B1, so that a reduction in the size of the vaporization unit 2 in which this preheater 23 is provided can also be achieved. Furthermore, the vaporization unit 2 can also be handled as a single unit gas panel.

Note that the present invention is not limited to the above-described embodiment.

For example, in the above-described embodiment, the main body unit is formed by connecting together a first body unit and a second body unit, however, it is also possible for the main body unit to be formed by a single block. In this case, the heater H1 and the heater H2 that are provided in the main body unit may be formed by a single heater. By then varying the temperature inside this single heater, it is possible to perform temperature control such as making the temperature of the mass flow controller 3 side hotter than that of the vaporization unit 2 side. These temperature variations can be achieved by, for example, changing the resistance value inside the single heater. Moreover, it is also possible to perform temperature control such as making the temperature of the mass flow controller 3 side hotter than that of the vaporization unit 2 side by making the distance between the single heater and the device mounting surface on the mass flow controller 3 side different from the distance between the single heater and the device mounting surface on the vaporization unit 2 side.

Moreover, it is also possible to not provide a mass flow controller in the vaporization system of the above-described embodiment, and to only provide at least a vaporizer and a supply rate controller.

Furthermore, the vaporization system of the above-described embodiment is an integrated body in which the vaporization unit and the mass flow controller are housed in a single housing, however, it is also possible to employ a structure in which the vaporization unit and the mass flow controller are mutually independent bodies, and the vaporization unit body unit and the mass flow controller body unit are connected to connecting conduits.

In the above-described embodiment, the main body unit B (i.e., B1 and B2) is positioned such that the longitudinal direction thereof is aligned in an up/down direction (i.e., in a vertical direction), however, it is also possible for the main body unit B to be positioned such that the longitudinal direction thereof is aligned in a left/right direction (i.e., in a horizontal direction).

Furthermore, it should be understood that the present invention is not limited to the above-described embodiment, and that various modifications and the like may be made thereto insofar as they do not depart from the spirit or scope of the present invention.

DESCRIPTION OF THE REFERENCE NUMERALS

100 . . . Vaporization system
B . . . Main body unit (manifold block)
B1 . . . First body unit
B1*x* . . . Device mounting surface
H1 . . . First heater
B2 . . . Second body unit
B2*x* . . . Device mounting surface
H2 . . . Second heater
2 . . . Vaporization unit
21 . . . Vaporizer
22 . . . Supply rate controller
23 . . . Preheater
3 . . . Mass flow controller
31 . . . Fluid detector
32 . . . Fluid control valve

The invention claimed is:

1. A vaporization system comprising:

a vaporizer that vaporizes a liquid material;

a supply rate controller that controls a supply rate of the liquid material to the vaporizer; and a manifold block configured in an elongated shape, inside which is formed an internal flow path having an intake port on a first end side along a longitudinal direction of the elongated shape and a discharge port on a second end side opposite the first end side along the longitudinal direction, and that has a device mounting surface on which both the vaporizer and the supply rate controller are mounted, wherein the vaporizer and the supply rate controller are arranged along the longitudinal direction of the elongated shape, and as a result of the vaporizer and the supply rate controller being mounted on the device mounting surface, the vaporizer and the supply rate controller are connected together via the flow path.

2. The vaporization system according to claim 1, wherein there is further provided a preheater that preheats the liquid material that is supplied to the vaporizer to a predetermined temperature, and, by mounting the preheater on the device mounting surface, the preheater is connected to the vaporizer and the supply rate controller via the flow path.

3. The vaporization system according to claim 1, wherein there are further provided:

a fluid detector that detects physical quantities relating to the flow rate of the vaporized gas created by the vaporizer; and a flow rate control valve that controls the flow rate of the vaporized gas created by the vaporizer, wherein by mounting the fluid detector and the flow rate control valve on the device mounting surface, the fluid detector and the flow rate control valve are connected to the vaporizer via the flow path.

4. The vaporization system according to claim 3, wherein the manifold block is constructed by connecting together a first body unit onto which the vaporizer and the supply rate controller are mounted, and a second body unit onto which the fluid detector and the flow rate control valve are mounted.

5. The vaporization system according to claim 4, wherein a first heater that heats the first body unit is provided in the first body unit, and a second heater that heats the second body unit is provided in the second body unit.

6. The vaporization system according to claim 1, wherein a liquid level sensor that detects the liquid level of the liquid material is provided inside the vaporizer, and vaporization is performed continuously by supplying the liquid material to the vaporizer by opening the supply rate controller intermittently in accordance with the liquid level of the liquid material that is detected by the liquid level sensor.

* * * * *